US005981081A

United States Patent [19]

Sue

[11] Patent Number: 5,981,081

[45] Date of Patent: Nov. 9, 1999

[54] TRANSITION METAL BORIDE COATINGS

[75] Inventor: Jiinjen Albert Sue, Indianapolis, Ind.

[73] Assignee: Union Carbide Coatings Service Corporation, Danbury, Conn.

[21] Appl. No.: 06/651,688

[22] Filed: Sep. 18, 1984

[51] Int. Cl.[6] ..... B22F 7/08; C22C 5/00

[52] U.S. Cl. ..... 428/564; 428/565; 75/248; 75/254

[58] Field of Search ..... 428/564, 565; 75/248, 254

[56] References Cited

U.S. PATENT DOCUMENTS

| | | | |
|---|---|---|---|
| 3,988,955 | 11/1976 | Engel et al. | 428/472 X |
| 4,233,072 | 11/1980 | Watanabe et al. | 428/564 X |
| 4,334,928 | 6/1982 | Hara et al. | 428/565 X |
| 4,341,841 | 7/1982 | Ohno et al. | 428/913 X |
| 4,389,465 | 6/1983 | Nakai et al. | 428/698 X |
| 4,401,724 | 8/1983 | Moskowitz et al. | 428/564 |
| 4,403,015 | 9/1983 | Nakai et al. | 428/697 X |
| 4,513,062 | 4/1985 | Suzuki et al. | 428/433 X |

*Primary Examiner*—Peter A. Nelson
*Attorney, Agent, or Firm*—Cornelius F. O'Brien

[57] ABSTRACT

A new family of transition metal boride coatings having excellent wear and corrosion resistance is disclosed. The coatings comprise hard, ultrafine, transition metal boride particles dispersed in a metal matrix, the particles constituting from about 30 to about 90 volume percent of the coating, the balance being metal matrix. The average size of the particles ranges from about 0.5 to about 3.0 microns. The metal matrix contains at least one metal selected from the group consisting of nickel, cobalt and iron. The coatings may be prepared by a process which comprises depositing a mechanically blended powder mixture of a transition metal and a boron-containing alloy onto a substrate and then heat treating the as-deposited coating. The heat treatment effects a diffusion reaction between the deposited elements resulting in the formation of ultrafine particles of a transition metal boride dispersed in the metal matrix. The coating can be deposited onto the substrate using any of the known deposition techniques.

30 Claims, 4 Drawing Sheets

TRANSITION METAL BORIDE COATINGS

RELATED APPLICATIONS

Copending application Ser. Nos. 651,789 and 651,690, filed on even date herewith and assigned to the common assignee hereof disclose subject matter which is related to the present invention.

BACKGROUND OF THE INVENTION

1. Field of the Invention

The present invention relates to transition metal boride coatings having excellent wear and corrosion resistance and to a process for preparing such coatings. More particularly, the invention relates to hard, dense, low porosity, wear and corrosion resistant coatings containing ultrafine particles of a transition metal boride dispersed in a metallic matrix. The invention also relates to a process for preparing such coatings in situ by thermal spray and diffusion reaction techniques.

Throughout the specification, reference will be made to plasma arc spraying and detonation gun (D-Gun) techniques for producing coatings. Typical detonation gun techniques are disclosed in U.S. Pat. Nos. 2,714,563 and 2,950,867. Plasma arc spray techniques are disclosed in U.S. Pat. Nos. 2,858,411 and 3,016,447. Other thermal spray techniques are also known, for example, so-called "high velocity" plasma and "hypersonic" combustion spray processes, as well as the various flame spray processes. Heat treatment of the coatings is necessary and may be done after deposition in a vacuum or inert gas furnace or by electron beam, laser beam, induction heating, transferred plasma arc or other technique. Alternative deposition techniques such as slurries, filled fabrics or electrophoresis, followed by heat treatment, are also known. Still other methods include simultaneous deposition and fusion utilizing plasma transferred arc, laser or electron beam surface fusion with or without post deposition heat treatment.

2. Background Art

Coatings containing transition metal borides are known in the art. The most common coatings are those produced by thermal spraying so-called "self-fluxing" Ni—Cr—B—Si—Fe alloys. These coatings contain low volume fractions of the boride (i.e. less than 25 vol. %). The metal borides used in the coating have been predominantly chromium borides.

Coatings have also been prepared by flame spraying powder mixtures of a transition metal carbide and a brazing alloy e.g. AMS 4777 (AWS BNi-2), onto a substrate. The so-prepared coatings contain essentially unreacted metal carbide in an alloy matrix. The matrix is usually precipitation strengthened with a low volume fraction of a transition metal boride, e.g., CrB. The total coating composition is essentially the same whether the coating is employed as-deposited or after post-coating fusion, except for minor interdiffusion with the substrate during heat treatment.

U.S. Pat. No. 4,173,685 issued to M. H. Weatherly on Nov. 6, 1979, discloses high-density wear and corrosion resistant coatings prepared by first depositing onto a substrate a coating having an as-deposited density greater than 75% of theoretical by methods such as plasma spray. The powder composition comprises two or more components, the first component containing a metal carbide such as tungsten, chromium or molybdenum carbide, and optionally a binder, e.g., nickel, iron or cobalt, and the second component containing an alloy or alloy mixture containing boron, e.g., Ni—B—Cr—Fe—Si. The first component constitutes 40 to 75 weight percent of the entire composition. The as-deposited coating is then heated to a temperature greater than about 950° C. for a period of time sufficient to cause substantial melting of the second component and reaction of the second component with a substantial portion of the first component. The coating is then cooled allowing the formation of borides, carbides, and intermetallic phases resulting in a hard, dense coating.

The microstructures of coatings prepared according to the Weatherly patent consist of fairly coarse, hard, acicular particles of metal carbide dispersed in a metal matrix. Although these coatings exhibit excellent wear properties, there are applications where the coatings cannot be used successfully because the carbide particles are too abrasive and result in excessive wear of mating components. Moreover, the coating and substrate when heat treated often expand or contract at different rates and this can result in undesirable microcracks or even spalling. Furthermore, due to interdiffusion reactions occurring between the coating and certain stainless steel substrates, chromium-rich carbides precipitate at grain boundaries and within the grains of the steel resulting in sensitization and loss of corrosion resistance.

SUMMARY OF THE INVENTION

The present invention is directed to a new family of transition metal boride coatings for use with a variety of substrates, e.g., steels, stainless steels, superalloys and the like. The coatings are prepared by a process which comprises depositing a mechanically blended powder mixture of a transition metal, metal alloy or compound and a boron-containing alloy onto a substrate and then heat treating the coating. The heat treatment effects a diffusion reaction between the deposited elements which results in the formation of ultra fine particles of a transition metal boride dispersed in a metal matrix. The coating can be deposited onto the substrate using any of the known depositions techniques mentioned earlier. As used herein and in the appended claims, the term "transitron metal" means a metal selected from Groups IVB, VB, and VIB of the Periodic Table.

More specifically, a coating according to the present invention comprises hard, ultrafine, transition metal boride particles dispersed in a metal matrix, the particles constituting from about 30 to about 90 volume percent of the coating, the balance being metal matrix. The atomic ratio of transition metal to boron in the coating is between about 0.4 and 2.0. The metal matrix is composed of at least one metal selected from the group consisting of nickel, cobalt and iron and may also contain one or more metals of the group consisting of molybdenum, chromium, manganese and aluminum. A small amount of excess or unreacted transition metal in addition to molybdenum or chromium, eg., tungsten etc. as well as other elements such as silicon, phosphorous, carbon, oxygen and nitrogen may also be present in the metal matrix.

DESCRIPTION OF THE PREFERRED EMBODIMENTS

Figure 1:
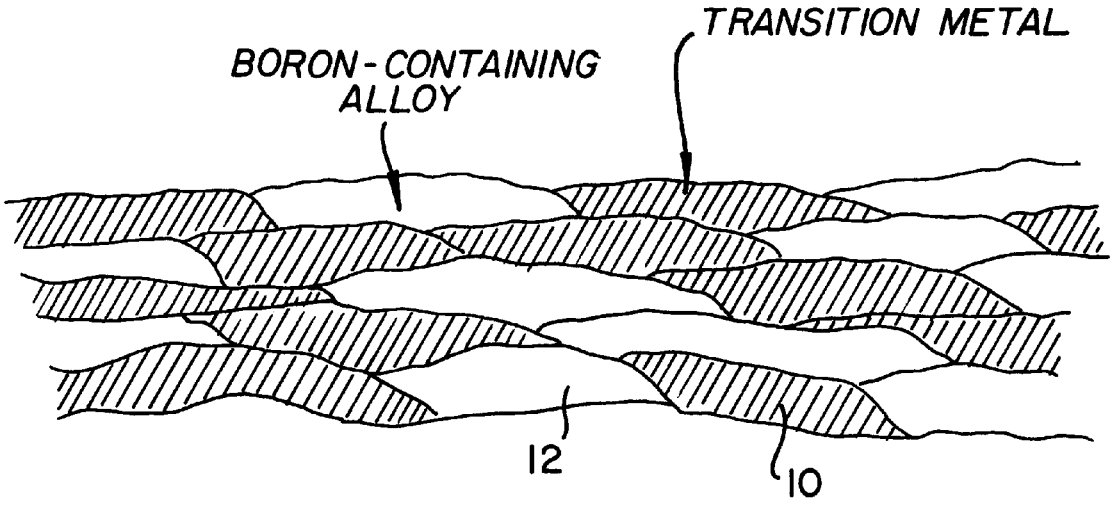
FIG. 1 is a schematic cross-sectional representation of a typical as-deposited coating according to the present invention.

The coatings of the present invention are preferably applied to a substrate using thermal spray processes. In one such process, i.e. plasma spraying, an electric arc is established between a non-consumable electrode and a second non-consumable electrode spaced therefrom. A gas is passed in contact with the non-consumable electrode such that it contains the arc. The arc-containing gas is constricted by a nozzle and results in a high thermal content effluent. The powdered coating material is injected into the high thermal content effluent and is deposited onto the surface to be coated. This process and plasma arc torch used therein are described in U.S. Pat. No. 2,858,411. The plasma spray process produces a deposited coating which is sound, dense, and adherent to the substrate. The deposited coating also consists of irregularly shaped microscopic splats or leaves which are interlocked and mechanically bonded to one another and also to the substrate.

Another method of applying the coatings to a substrate is by detonation gun (D-Gun) deposition. A typical D-Gun consists essentially of a water-cooled barrel which is several feet long with an inside diameter of about one inch. In operation, a mixture of oxygen and a fuel gas, e.g., acetylene, in a specified ratio (usually about 1:1) is fed into the barrel along with a charge of powder to be coated. The gas is then ignited and the detonation wave accelerates the powder to about 2400 ft/sec (730 m/sec) while heating the powder close to or above its melting point. After the powder exits the barrel, a pulse of nitrogen purges the barrel and readies the system for the next detonation. The cycle is then repeated many times a second.

The D-Gun deposits a circle of coating on the substrate with each detonation. The circles of coating are typically about 1 inch (25 mm) in diameter and a few ten thousandths of an inch (i.e., several microns) thick. Each circle of coating is composed of many overlapping microscopic splats corresponding to the individual powder particles. The overlapping splats interlock and bond to each other and to the substrate without substantially alloying at the interface thereof. The placement of the circles in the coating deposition are closely controlled to build-up a smooth coating of uniform thickness and to minimize substrate heating and residual stresses in the applied coating.

As a general rule, the powdered coating material used in the thermal spray process will have essentially the same composition as the applied coating itself. With some thermal spray equipment, however, changes in composition may be expected and in such cases the powder composition will be adjusted accordingly to achieve the desired coating composition.

Although the present invention will be described hereinafter with particular reference to coatings prepared by plasma arc spray processes, it will be understood that any of the known deposition techniques mentioned above or similar techniques can also be employed.

According to the present invention, wear and corrosion resistant coatings are applied to substrates such as stainless steels by plasma spraying a mechanically blended powder mixture containing particles of a transition metal, metal alloy or compound and a boron-containing alloy or mixture of alloys, followed by heat treatment at elevated temperatures, e.g., from about 900 to 1200° C. At these temperatures, diffusion and chemical reactions occur between the thin overlapping splats deposited by the plasma spray process, some of which contain the transition metal component and others of which contain the boron-containing alloy or mixture of alloys. These diffusion and chemical reactions result in the formation of boride precipitates which are dispersed in a metal matrix. The precipitates are usually dispersed uniformly thoughout the matrix, although in some cases they may be aggregated in small clusters which are distributed evenly in the matrix. Depending upon the particular transition metal employed, the boride precipitates may be "simple" or "complex" borides as will be described hereinafter in greater detail. Essentially no reaction takes place between the powder particles during deposition so that the splats, before heat treatment, retain their initial powder composition.

Referring to the accompanying drawing, FIG. 1 shows the microstructure of a typical as-deposited coating. As shown, the coating consists essentially of multiple, thin, irregularly shaped splats overlying and bonded to one another in a continuous lamellar structure. Some of the splats contain the transition metal as indicated at 10 while other splats contain the boron-containing alloy as shown at 12.

Figure 2:
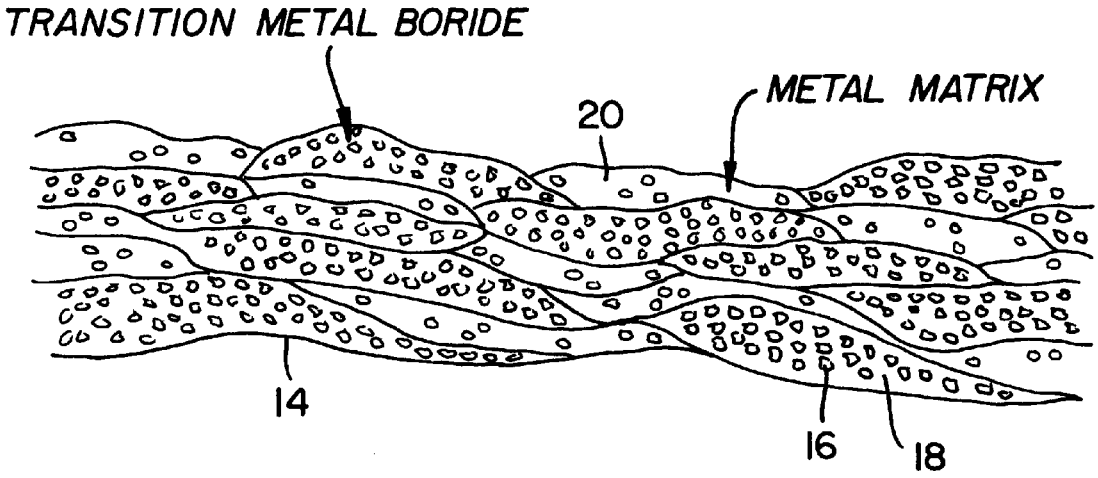
FIG. 2 is a schematic cross-sectional representation of the same coating after heat treatment according to the present invention.

The microstructure of the coating after heat treatment is depicted in FIG. 2. Most of the splats 14 contain ultrafine precipitates 16 of the transition metal boride dispersed in the metal matrix 18. The remaining splats 20 contain only the alloy with little or no precipitation. In both FIGS. 1 and 2, the substrate has been omitted for purposes of simplicity.

The coatings of the present invention may be prepared using a two component system as described, namely, a first transition metal component and a second boron-containing alloy component or alternatively, a multiple component system may be employed. These multiple component systems may include an additional metal or metals or metal alloys and may be used in those situations where the desired properties of a coating cannot be achieved by employing a two component system alone. An additional reactant metal may also be used in those situations where it is desired to form a coating containing certain complex transition metal borides. For purposes of convenience, a two or three component system will be considered in the following description.

The formation of coatings containing "simple" or "complex" transition metal borides proceeds according to one of the following equations:

(A) Simple Boride System

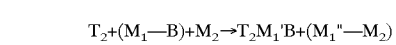

$$T_1+(M_1—B)\rightarrow T_1B+M_1 \quad (1)$$

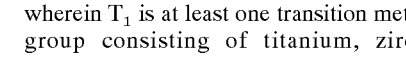

$$T_1+(M_1—B)+M_2\rightarrow T_1B+(M_1—M_2) \quad (2)$$

(B) Complex Boride System

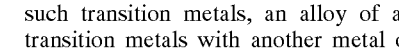

$$T_2+(M_1—B)\rightarrow T_2M_1'B+M_1'' \quad (3)$$

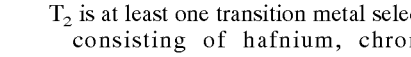

$$T_2+(M_1—B)+M_2\rightarrow T_2M_2'B+(M_1—M_2'') \quad (4)$$

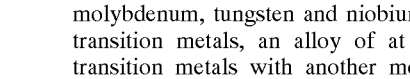

$$T_2+(M_1—B)+M_2\rightarrow T_2M_1'B+(M_1''—M_2) \quad (5)$$

wherein $T_1$ is at least one transition metal selected from the group consisting of titanium, zirconium, hafnium, vanadium, chromium, tantalum, and niobium, an alloy of such transition metals, an alloy of at least one of such transition metals with another metal or a transition metal compound;

$T_2$ is at least one transition metal selected from the group consisting of hafnium, chromium, tantalum, molybdenum, tungsten and niobium, an alloy of such transition metals, an alloy of at least one of such transition metals with another metal or a transition metal compound;

B is boron;

$M_1$ is at least one metal selected from the group consisting of nickel, cobalt and iron and optionally one or more metals selected from the group consisting of chromium, silicon, phosphorous, aluminum, manganese, and a transition metal ($T_1$ or $T_2$) other than chromium.

$M_2$ is one or more metals or metal alloys.

$M_1=M_1'+M_1''$, and $M_2=M_2'+M_2''$

The purpose of the metal $M_2$ is to modify the properties of the matrix in the case of Equations (2) and (5) and also to modify the properties of the transition metal boride in the case of Equation (4).

In addition to the elements mentioned, $M_1$ and $M_2$ may also contain small amounts of other elements such as carbon, oxygen and nitrogen.

For a clearer understanding of the present invention, each of the Equations (1)–(5) above will now be illustrated by a specific example:

In Equation (1) where:

$T_1$ is titanium; and ($M_1$—B) is Ni—B—Cr—Si—Fe

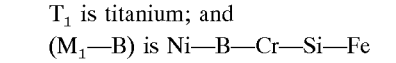

$$Ti+Ni—B—Cr—Si—Fe\rightarrow TiB_2+Ni—Cr—Si—Fe$$

In Equation (2) where:

$T_1$ is titanium;

($M_1$—B) is Ni—B—Cr—Si—Fe; and $M_2$ is manganese

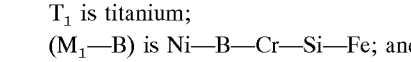

$$Ti+Ni—B—Cr—Si—Fe+Mn\rightarrow TiB_2+Ni—Cr—Si—Fe—Mn$$

In Equation (3) where:

$T_2$ is molybdenum; and ($M_1$—B) is Ni—B—Cr—Si—Fe

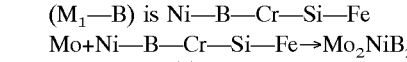

$$Mo+Ni—B—Cr—Si—Fe\rightarrow Mo_2NiB_2+Ni—Cr—Si—Fe$$

In Equation (4) where:

$T_2$ is molybdenum;

($M_1$—B) is Ni—B—Cr—Si—Fe; and $M_2$ is a Co—Cu alloy

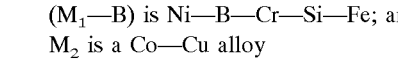

$$Mo+Ni—B—Cr—Si—Fe+Co—Cu\rightarrow Mo_2CoB_2+Ni—Cr—Si—Fe—Cu—Co$$

In Equation (5) where:

$T_2$ is molybdenum ($M_1$—B) is Ni—B—Cr—Si—Fe; and $M_2$ is a Ni—Cr alloy:

$$Mo+Ni—B—Cr—Si—Fe+Ni—Cr\rightarrow Mo_2NiB_2+Ni—Cr—Si—Fe$$

It should be noted that in the example of Equation (4) above, some of the Co in the metal alloy $M_2$ is partitioned to the boride or hard phase while the remainder is incorporated in the metal matrix.

Although the transition metal, alloy or compound used to prepare a coating according to the present invention may be or contain any one or more of the metals chosen from groups IVB, VB and VIB of the Periodic Table, the preferred coatings are prepared using niobium, chromium, molybdenum, titanium, zirconium and tungsten as well as combinations thereof. Coatings prepared using molybdenum as the transition metal are the most preferred as will become apparent hereinafter.

The boron-containing alloy must contain at least one metal selected from the group consisting of nickel, cobalt and iron and may also contain chromium, manganese, aluminum, silicon and phosphorus as well as small amounts of other elements such as carbon, oxygen and nitrogen.

The boron-containing alloy may also contain some additional transition metal or metals; however, these are present in amounts which are small enough not to interfere with the reaction between the transition metal in the first component and the boron in the second component. The amount of transition metal in the boron-containing alloy must be balanced with enough boron over and above that required for reaction with the transition metal in the first component.

The proportion of transition metal and boron used in the powder mixture determines the volume fraction of the transition metal borides that precipitate in the metal matrix. For optimium wear resistance, the volume fraction of the transition metal borides should be maintained in the range of from about 30 to about 90 volume percent, preferably from about 40 to 80 volume percent.

It has been found that coatings can be prepared with a volume fraction of the transition metal borides within the above range if the elements in the boron-containing alloy are kept within the following weight proportions: from about 3.0 to about 30 wt. % boron, 0 to about 10.0 wt % molybdenum, 0 to about 30.0 wt % chromium, 0 to about 5.0 wt % manganese, 0 to about 10.0 wt % aluminum, 0 to about 2.0 wt. % carbon, 0 to about 6.0 wt % silicon, 0 to about 5.0 wt. % phosphorus, 0 to about 5.0 wt. % copper, and 0 to about 3.0 wt. % magnesium, the balance being nickel, cobalt, iron or combinations thereof.

The ratio of transition metal to boron employed in the powder mixture will determine the type of transition metal boride that is formed as a result of the diffusion reaction. Generally, the ratio should be kept in a range of from about 0.4 to about 2.0. Alloys prepared with a ratio of transition metal to boron in the lower portion of this range represent transition metal diborides ($TB_2$) or higher borides ($T_2B_5$), while in the higher range represent transition metal borides such as $T_2B$.

Table I below gives the weight proportion of various transition metals and boron that could be used in typical coatings to provide a volume fraction of the transition metal boride of at least 30 percent, the minimum volume fraction of metal boride. The larger value for each boride is based on a calculation assuming an arbitrarily chosen boron content in the binder of 20 wt. % and a matrix phase density of 8.0 grams/cm$^3$. In the case of the preferred transition metal, i.e. Mo, it will be seen that the metal will be in a range of from about 25 to 70 wt. % of the coating. It should be understood, of course, that the values given in Table I are illustrative only and are not intended in any way to limit the scope of the invention.

TABLE I

| Transition Metal Boride | Density of Boride (g/cm$_3$) | Volume Fraction of Boride in the Coating (%) | Wt. % of Transition Metal in the Coating | Wt. % of Boron-Containing Alloy in the Coating | Wt. % of Boron in the Coating |
|---|---|---|---|---|---|
| TiB | 5.09 | 30 | 17.5 | 82.5 | 3.9 |
| | | 68 | 47 | 53 | 10.6 |
| $TiB_2$ | 4.38 | 30 | 13 | 87 | 5.9 |
| | | 60 | 31 | 69 | 13.8 |
| ZrB | 5.7 | 30 | 23.4 | 76.6 | 2.5 |
| | | 77 | 63 | 37 | 7.4 |
| $ZrB_2$ | 6.17 | 30 | 20 | 80 | 4.8 |
| | | 63 | 46 | 54 | 10.8 |
| HfB | 12.4 | 30 | 37.6 | 62.4 | 2.28 |
| | | 68 | 76.8 | 23.2 | 4.64 |
| $HfB_2$ | 10.5 | 30 | 32 | 68 | 3.9 |
| | | 56 | 62.3 | 3.6 | 7.54 |
| $V_3B_2$ | 5.8 | 30 | 20.8 | 79.2 | 2.94 |
| | | 73.6 | 58.6 | 41.4 | 8.28 |
| $VB_2$ | 5.1 | 30 | 15.1 | 84.9 | 6.4 |
| | | 57 | 32 | 68 | 13.6 |
| $Nb_3B_2$ | 7.9 | 30 | 27.84 | 72.16 | 2.16 |
| | | 77.8 | 72 | 28 | 5.6 |
| $NbB_2$ | 7.0 | 30 | 22.1 | 77.9 | 5.2 |
| | | 60 | 46.2 | 53.8 | 10.76 |
| $Ta_2B$ | 15.2 | 30 | 43.7 | 56.3 | 1.3 |
| | | 82 | 87 | 13 | 2.6 |
| $TaB_2$ | 12.4 | 30 | 35.7 | 64.3 | 4.27 |
| | | 60 | 62.6 | 37.4 | 7.48 |
| $Cr_2B$ | 6.11 | 30 | 21.88 | 78.12 | 2.32 |
| | | 77.7 | 65.8 | 34.2 | 6.84 |
| CrB | 6.05 | 30 | 20.28 | 79.72 | 4.22 |
| | | 66 | 49 | 51 | 10.2 |
| $CrB_2$ | 5.22 | 30 | 14.5 | 85.5 | 5.0 |
| | | 57 | 32.5 | 67.5 | 13.5 |
| $Mo_2B$ | 9.1 | 30 | 31.2 | 68.8 | 1.76 |
| | | 81 | 78 | 22 | 4.4 |
| MoB | 8.3 | 30 | 27.86 | 72.14 | 3.14 |
| | | 71 | 64 | 36 | 7.2 |
| $Mo_2B_5$ | 7.0 | 30 | 16.4 | 83.6 | 4.6 |
| | | 60 | 42 | 58 | 11.6 |
| $W_2B$ | 16 | 30 | 44.68 | 55.32 | 1.31 |
| | | 81.4 | 87.2 | 12.8 | 2.56 |
| $W_2B_5$ | 11 | 30 | 32 | 68 | 5.11 |
| | | 58.6 | 57.6 | 42.4 | 8.47 |
| $Mo_2NiB_2$ | 8.5 | 30 | 25 | 75 | 2.72 |
| | | 90 | 63.8 | 36.2 | 7.18 |
| $W_2NiB_2$ | 10 | 30 | 28.6 | 71.4 | 1.68 |
| | | 90 | 75.3 | 24.7 | 4.43 |

Most any boron-containing alloy can be used to prepare coatings according to the present invention so long as the alloy satisfies the reaction requirements for one of the Equations (1)–(5) above as well as providing the desired elements in the metal matrix. Alloys which are particularly suited for use in preparing coatings according to the present invention are given in Table II below.

TABLE II

BORON-CONTAINING ALLOYS

| | Composition | (Weight %) | | | |
|---|---|---|---|---|---|
| Alloy No. | Ni | B | Cr | Si | Fe |
| 1 | Balance | 3 | 7 | 4 | 4 |
| 2 | Balance | 7.3 | 3.2 | 2.6 | |
| 3 | Balance | 14 | | | |
| 4 | Balance | 8.9 | 3.0 | 2.2 | 2.7 |
| 5 | Balance | 6 | 20 | | |
| 6 | Balance | 9 | 3.5 | 3.7 | 2.7 |

It is important in the practice of the present invention to heat treat the as-deposited coating at a sufficiently elevated temperature for the boron-containing alloy to be fluid enough to promote the diffusion reaction, typically above 900° C. The heat treatment temperature can be substantially higher than 900° C. if desired, e.g. about 1200° C., but the temperature should not be so high as to detrimentally affect the substrate. The as-deposited coating should be maintained at the heat treatment temperature for a time sufficient to promote the reaction and/or diffusion between the components of the coating. A limited, but important, amount of diffusion reaction occurs also with the substrate.

The heat treatment of the coating is generally carried out in a vacuum or an inert gas furnace. Alternatively, the heat treatment can be achieved by surface fusion processes such as electron beam, laser beam, transferred plasma arc, induction heating or other technique so long as the time at elevated temperature is sufficiently short or a protective atmosphere is provided such that no significant oxidation occurs.

The coatings of the present invention can be applied with success to almost any type of substrate using the known deposition techniques described above. However, the substrate must be able to withstand the effects of heat treatment without any harmful result. Suitable substrate materials which can be coated according to the present invention include, for example, steel, stainless steel, iron base alloys, nickel, nickel base alloys, cobalt, cobalt base alloys, chromium, chromium base alloys, titanium, titanium base alloys, refractory metals and refractory-metal base alloys.

Generally, the thickness of coatings prepared according to the present invention will vary from about 0.005 to about 0.04 inch (0.1 to 1.0 mm).

The microstructures of the coatings of the present invention are somewhat complex and not fully understood. However, it is known from studies so far conducted that the coatings contain a hard phase comprising ultrafine particles of a transition metal boride dispersed in a metal matrix. The metal matrix is essentially crystalline, relatively dense, softer than the hard phase and has a low permeability.

The size of the transition metal boride particles will vary depending upon several factors including the heat treatment temperature and time. However, the average particle size will usually be sub-micron, typically from about 0.5 to about 3.0 microns.

Generally speaking, the hardness of the coatings varies in direct proportion to the volume fraction of the hard phase. Thus, it is possible to tailor the hardness to a particular range of values by varying the mole ratio of transition metal to boron within the powder mixture. The hardness of the coatings generally ranges from about 500 to about 1200 $DPH_{300}$.

An important advantage of the present invention is that the diffusion reaction between the transition metal and the boron-containing alloy takes place at relatively low heat treatment temperatures, e.g. about 1000° C. Although the exact reason for this phenomenon is not understood, it is believed to be due to the build-up of high internal stresses and dislocations inside the lamellar splats or leaves that are deposited onto the substrate by thermal spraying. In contrast, transition metal borides are normally formed by conventional casting or hot pressed methods at significantly higher temperatures, i.e. greater than about 1300° C. These higher temperatures are usually detrimental to most steels. Due to the low heat treatment temperatures required in the present coating process, these substrates can now be coated without any harmful effects.

The following examples will serve to further illustrate the practice of the present invention.

EXAMPLE I

A number of CrB coatings were prepared by plasma spraying powder mixtures of chromium and a boron-containing alloy onto AISI 1018[1] steel specimens measuring ¾×½×2½ inches (19×13×64 mm) to a thickness of about 0.020 inch (0.5 mm). The alloy used in each powder mixture was either Alloy No. 3+45 Cr or Alloy No. 4+30 Cr. (All compositions will be expressed hereinafter in weight percent, e.g. 55 wt. % Alloy No. 3+45 wt. % Cr equals Alloy No. 3+45 Cr.) The Cr to B atomic ratio was about 1. The as-deposited coatings were heat treated for one hour at temperatures of from about 980 to 1040° C. in either a vacuum or argon furnace. After heat treatment, the coatings were cooled and then examined. The coatings had a lamallar structure of splats containing CrB precipitates dispersed in a metal matrix. The precipitates were partly aggregated in small clusters which were evenly distributed in the matrix. The formation of the CrB precipitates proceeded according to Equation (1) above.

[1] AISI 1018 steel is a low carbon steel (approx. 0.18 C. balance Fe).

In the coatings prepared from Alloy No. 3, the metal matrix was composed essentially of nickel. The volume fraction of CrB precipitates was about 60%. In the coatings prepared from Alloy No. 4, the metal matrix was composed of Ni—Cr—Si—Fe and the volume fraction of the CrB precipitates was about 43%.

The hardness of the CrB coatings was greater than 700 $DPH_{300}$ (HV.3).

Abrasive wear properties of the CrB coatings prepared above were determined using a standard dry sand/rubber wheel abrasion test described in ASTM Standard G65–80, Procedure A. In this test, the coated specimens were loaded by means of a lever arm against a rotating wheel with a chlorobutyl rubber rim around the wheel. An abrasive (i.e., 50–70 mesh Ottawa Silica Sand) was introduced between the coating and the rubber wheel. The wheel was rotated in the direction of the abrasive flow. The test specimens were weighed before and after the tests and their weight loss was recorded. Because of the wide differences in the densities of different materials tested, the mass loss is normally converted to volume loss to evaluate the relative ranking of the materials. The average volume loss for these particular coating specimens was 4.8 $mm^3$/1000 revolutions.

The CrB coatings were also subjected to erosion tests. These tests were conducted according to standard procedures using alumina particles with a nominal size of 27 microns and a particle velocity of about 91 meters/sec. at two impingement angles of 90° and 30°. The erosion rates were found to be about 124 and 37 $\mu$m/gm, respectively.

The abrasion and erosion resistances of the CrB coatings were considered to be reasonably good when compared to conventional flame spray WC-Co coatings.

EXAMPLE II

A number of $Mo_2NiB_2$ coatings were prepared by plasma spraying powder mixtures of molybdenum and Alloy No. 1 onto AISI 1018 steel specimens measuring ¾×½×2½ inches to a thickness of about 0.020 inch (0.5 mm). The amount of molybdenum employed in the mixtures varied from 15 to 38 wt. percent. The atomic ratio of Mo to B also varied from 0.66 to 2.30. The as-deposited coatings were heat treated for one hour at temperatures of from about 980 to 1040° C. in either vacuum or argon. After heat treatment, the coatings had a lamellar structure of $Mo_2NiB_2$ precipitates dispersed in a Ni—Cr—Si—Fe matrix. The precipitates were formed by a diffusion reaction which proceeded according to Equation (3) above. The volume fraction of the $Mo_2NiB_2$ precipitates varied from 22 to 45 percent.

The mechanical and physical properties of several of these $Mo_2NiB_2$ coatings are given in Table III below.

TABLE III

| Coating | Atomic Ratio of Mo/B | Thermal Expansion Coefficient (×10⁶/° C.) 25–400° C. | 400–1075° C. | Elasticity Modulus (×10⁶ psi) | Strain to Fracture (%) | Rupture Modulus (×10³ psi) | Volume Fraction Precipitates |
|---|---|---|---|---|---|---|---|
| Alloy No. 1 + 38 Mo | 2.3 | 10.00 | 10.71 | 29.3 | 0.388 | 113.6 | 45 |
| Alloy No. 1 + 30 Mo | 1.6 | 11.33 | 12.86 | 23.6 | 0.464 | 108.1 | 38 |
| Alloy No. 1 + 25 Mo | 1.1 | 12.00 | 13.57 | 21.5 | 0.621 | 133.4 | 30 |

It will be seen from Table III that the properties of the coatings vary over a wide range with varying proportion of molybdenum.

The hardness of these $Mo_2NiB_2$ coatings was in the range of from 500 to 670 $DPH_{300}$ (HV.3).

Abrasive wear properties of the $Mo_2NiB_2$ coatings were also determined using the standard dry sand/rubber wheel test described in Example I. The average wear rate for these coatings was found to vary depending upon the volume fraction of the hard phase. For example, coatings containing boride precipitates ranging from about 30 to 45 volume 5% exhibit an abrasive wear rates of from about 4.5 to 2.8 $mm^3$/1000 revolutions whereas coatings containing only 22 volume % of the boride prepipitates exhibit a significantly higher wear rate of 8.3 $mm^3$/1000 revolutions. The latter coating was prepared by plasma spraying powder mixtures containing 15 wt. % Mo and Alloy No. 1.

The dry adhesive wear resistance of the $Mo_2NiB_2$ coatings was evaluated using a block-on-ring (alpha) tester. A coated ring having a detonation gun (W,Cr)C-Co coating produced by Union Carbide Corp. under the designation UCAR[2] LW-15, was rotated against a stationary block coated with the test coatings. The test conditions were fixed at 80° oscillation, 2000 cycles, 164 Kg (360 lbs.) normal load and 18 m/min. (60 ft./min.) rotating speed in dry air at room temperature. The adhesive wear resistance of the coating was determined by measuring the volume loss based on measurements of wear, scar length and width on the block and weight loss on the ring. The coatings prepared with 38 wt. % Mo had excellent dry adhesive wear resistance to LW-15 which was comparable to that of conventional weld-deposited overlay coatings (0.65 C, 11.5 Cr, 2.5 B, 2.75 Si, 4.25 Fe, balance Ni).

[2] UCAR is a trademark of Union Carbide Corp.

EXAMPLE III

A number of $Mo_2$ $NiB_2$ coatings were prepared by plasma spraying powder mixtures of molybdenum and Alloy No. 4 onto ¾×½×2½ inch AISI 1018 steel specimens to a thickness of about 0.020 inch (0.5 mm). Approximately 45 wt. % molybdenum was employed in the powder mixtures. The as-deposited coatings were heat treated for one hour at temperatures of from about 980° C. to 1060° C. in vacuum or argon and then cooled. The coatings had a lamellar structure with $Mo_2NiB_2$ precipitates uniformly dispersed in a Ni—Cr—Si—Fe matrix. The precipitates were formed by a diffusion reaction which proceeded according to Equation (3) above. The volume fraction of the hard phase in these coatings was approximately 64 percent.

The hardness of these $Mo_2NiB_2$ coatings was about 700 $DPH_{300}$ (HV.3).

Abrasive wear properties of the coatings were also determined using the standard dry sand/rubber wheel test and the average wear rate was found to be 1.3 $mm^3$/1000 revolutions. This was less than the wear rate of the coating prepared in Example II.

EXAMPLE IV

A number of $Mo_2NiB_2$ coatings were prepared by plasma spraying powder mixtures of molybdenum, Alloy No. 4 and chromium onto various metallic specimens such as AISI 1018 steel, Incoloy 825[3], Inconel 625 and Hastelloy[4] alloy G and C-276, each of the specimens measuring ¾×½×2½ inches, to a thickness of about 0.020 inch (0.5 mm). The chromium powder was added to the mixture in order to increase the corrosion resistance of the coating. The amount of molybdenum and chromium employed in the mixtures was varied in such a manner as to maintain a Mo to B ratio of about 1.0 while varying the Cr content. The mix formulations were as follows:

(1) Alloy No. 4+43.3 Mo+3.9 Cr (2) Alloy No. 4+41 Mo+7.3 Cr (3) Alloy No. 4+40 Mo+11.3 Cr.

Another formulation was made using a different alloy, i.e., Alloy No. 3. This formulation consisted of Mo+42 Alloy No. 3+5 Cr. Coatings were prepared by plasma spraying this formulation onto AISI 1018 steel specimens in the same manner as described above.

[3] Incoloy and Inconel are trademarks of International Nickel Co. [4] Hastelloy is a trademark of Cabot Corp.

The as-deposited coatings were heat treated for one hour at temperatures of from about 980 to 1040° C. in vacuum or argon and then cooled. The coatings had a lamellar structure of $Mo_2NiB_2$ precipitates aggregated in a Ni—Cr—Si—Fe matrix.

The hardness of these $Mo_2NiB$ coatings was greater than 500 $DPH_{300}$ (HV.3).

Abrasive wear and erosion properties of the coatings were determined using the same test procedures described in Example I. The sand abrasion wear rate of these coatings varied between 1.3 and 1.8 $mm^3$/1000 revolutions which was comparable to that of tungsten carbide based coatings prepared according to the Weatherly patent, supra. The erosive wear rate to alumina particles at 90° and 30° impingement angles was found to be approximately 75 and 25 micrometers ($\mu$m) per gram, respectively. The erosion wear rate to silica dust (nominal particle size of 15 microns and velocity of 139 m/sec.) of the coatings prepared from Alloy No. 4+41.7 Mo+7.3 Cr at 90° and 30° impingement angles was 1.8 and 0.6 micrometers ($\mu$m) per gram, respectively. The erosive wear resistance of these particular coatings to silica dust was at least two times higher than that of conventional detonation gun tungsten carbide-cobalt coatings and approximately four times greater than that of the tungsten carbide based coatings prepared according to the Weatherly patent.

Corrosion tests were performed on this series of $Mo_2NiB_2$ cotaings and the Alloy No. 4+45 Mo coating. These $Mo_2NiB_2$ coatings had a Mo/B atomic ratio of 1.03 and a Cr content varying from 1.7 to 12.4 wt. %. The tests consisted of immersing free-standing samples in test solutions of 5 wt. % $HNO_3$, 5 wt. % $H_2SO_4$, 20 wt. % HCl and 50 wt. 7% NaOH for 200 hours at room temperature. The coating samples were weighted periodically and weight loss was recorded and converted to a corrosion rate in units of mils (thousandths of an inch) per year (mpy). Alloy No. 4+45 Mo showed outstanding corrosion resistance to 50 wt. % NaOH, good resistance to both 5 wt. % $H_2SO_4$ and 20 wt. % HCl and poor resistance to 5 wt. % $HNO_3$. In general, the Alloy No. 3 or 4+Mo+Cr coatings had excellent corrosion resistance to 50 wt. % NaOH. The corrosion resistance of these coatings to $HNO_3$ was increased substantially due to the addition of Cr. The corrosion rate of these coatings in 5 wt. % $HNO_3$ solution descreased from greater than 200 to 26 mpy when the Cr content of the coating increased from 1.7 up to 9.0 wt. %. A further increase of Cr content caused some reduction in corrosion resistance to $HNO_3$ acid. The corrosion resistances of all these coatings to 5 wt. % $H_2SO_4$, 20 wt. % HCl and 50 wt. % NaOH solutions were decreased with the addition of Cr to the powder mixture, the amount of decrease becoming greater with increasing Cr content. This was attributed to the chemical compositions of the matrix phase in the coating. Thus, a compromise in composition may be necessary to achieve desired corrosion properties for a particular application.

EXAMPLE V

A number of $Mo_2NiB_2$ coatings were prepared by plasma spraying powder mixtures of molybdenum, Alloy No. 2 and an alloy of nickel-20 chromium onto AISI 1018 steel, AISI 316[5] stainless steel and Inconel 718 specimens measuring ¾×½×2½ inches to a thickness of about 0.020 inch (0.5 mm). In these powder mixtures, the Ni-20 Cr was employed to increase both the corrosion resistance and toughness of the coating. The mixtures were formulated using varying amounts of both molybdenum and Ni-20 Cr. The mix formulations were as follows:

(1) Alloy No. 2+33 Mo+17 (Ni-20 Cr)

(2) Alloy No. 2+38 Mo+7 (Ni-20 Cr)

The as-deposited coatings were heat treated for one hour at temperatures of from 980 to 1040° C. in a vacuum or argon.

The coatings were then cooled and examined. The coatings had a lamellar structure of submicron $Mo_2NiB_2$ precipitates dispersed in a Ni—Cr—Si—Fe matrix.

[5] AISI 316 is an austenitic stainless steel (approx. 17 Cr-12 Ni-2.5 Mo-0.08 C max, balance Fe).

Figure 3:
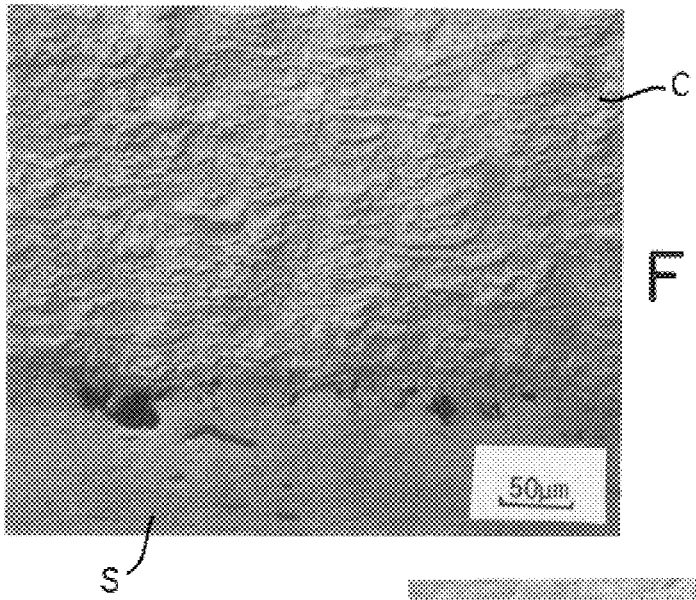
FIG. 3 is a photomicrograph taken at a magnification of 200× and showing a cross-section of an actual as-deposited coating containing molybdenum and a Ni—B alloy plasma sprayed onto a steel substrate.
Figure 4:
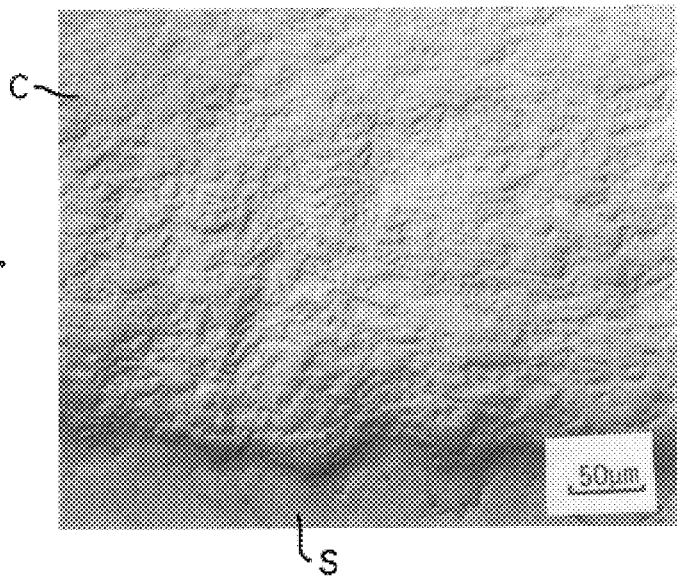
FIG. 4 is a photomicrograph taken at a magnification of 200× and showing a cross-section of a $Mo_2NiB_2$ coating formed by heat treating the as-deposited coating of FIG. 3.
Figure 5:
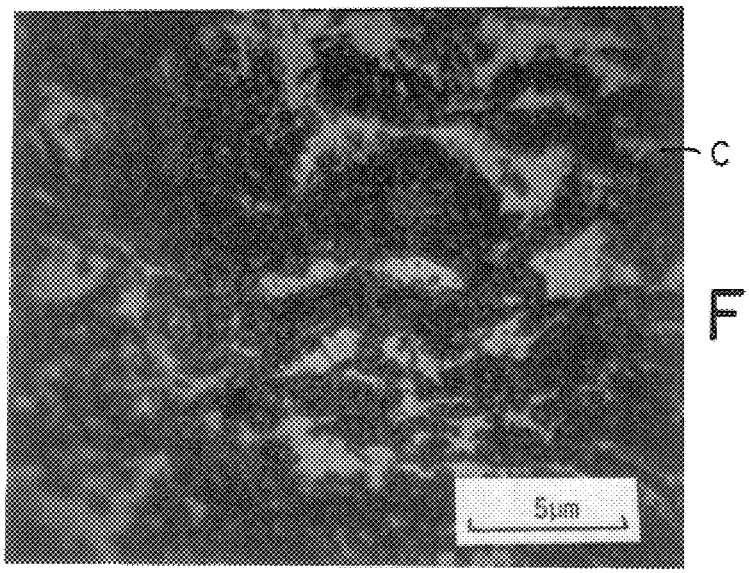
FIG. 5 is a photomicrograph taken at a magnification of 1000× and showing in enlarged detail the microstructure of the $Mo_2NiB_2$ coating of FIG. 4.

FIGS. 3–5 show the microstructures of typical coated specimens prepared by plasma spraying a powder mixture of Alloy No. 2+38 Mo+7 (Ni-20 Cr) onto AISI 1018 steel. The microstructure of the as-deposited coating is shown in FIG. 3. FIG. 4 shows the microstructure of the same coating after heat treatment. In all the photomicrographs, C refers to the coating, and S refers to the substrate. The microstructure of a polished and etched specimen of this coating at a greater magnification of 1000× is shown in FIG. 5. This photomicrograph reveals the $Mo_2NiB_2$ precipitates (dark areas) in a metal matrix intermixed in a lamellar structure with a Ni—Cr—Si—Fe phase (light areas).

Abrasive wear and erosion properties of these coatings were also determined using the same test procedures described in Example I. It was found that coatings prepared by plasma spraying powder mixtures of Alloy No. 2+38 Mo+7 (Ni-20 Cr) exhibited excellent abrasion and erosion wear resistance while coatings prepared in the same manner using powder mixtures of Alloy No. 2+33 Mo+17 (Ni-20 Cr) were more susceptible to abrasive and erosive wear. In the dry sand/rubber wheel abrasion test, for example, the average wear rate for the former coatings ranged from 1.7 to 1.9 $mm^3$/1000 revolutions while that for the latter coatings was about 2.7 $mm^3$/1000 revolutions. However, due to the increase in chromium and nickel content, the latter coatings exhibited a greater toughness.

Corrosion tests were carried out on $Mo_2NiB_2$ coatings prepared by plasma spraying a powder mixture of Alloy No. 2+38 Mo+7 (Ni-20 Cr) onto AISI 316 stainless steel specimens. For comparison purposes, tungsten carbide coatings plasma sprayed onto the same AISI 316 stainless steel specimens according to the Weatherly patent, supra, were also tested. Table IV below summarizes the mechanical, physical and wear properties of both coatings employed in the test.

TABLE IV

| | Tungsten Carbide Base coating | $Mo_2$ $NiB_2$ Coating |
|---|---|---|
| Heat Treatment | 1050° C./ 1 hr./vac. | 1020° C./ 1 hr./vac. |
| Apparent Porosity (%) | 0.5 | 0.1 |
| Oxides (%) | trace | trace |
| Hardness $DPN_{300}$ (HV.3) | 1040 ± 102 | 610 ± 104 |
| Elasticity Modulus ($10^6$ psi) | 40 | 27.4 |
| Rupture Modulus ($10^3$ psi) | 153 | 120 |
| Strain to Fracture (%) | 0.38 | 0.44 |
| Thermal Expansion Coefficient (in/in - ° C.) | | |
| 25–400° C. | 9.4 | 10.5 |
| 400–1075° C. | 10.3 | 12.1 |
| Density (g/$cm^3$) | 10.7 | 8.2 |
| Sand Abrasive Wear ($mm^3$/1000 rev.) | 1.2–1.5 | 1.7–1.9 |
| Alumina Erosive Wear ($\mu$/g) | | |
| 30° | 16 | 24 |
| 90° | 99 | 87 |
| Silica Dust Erosive Wear | | |
| 30° | 3.10 | 1.50 |
| 90° | 8.40 | 3.4 |

It will be seen from Table IV that the mechanical, physical and wear properties of the two coatings are for the most part comparable. However, the corrosive properties of the coatings when coupled with AISI 316 stainless steel substrates are significantly different as shall now be explained.

In austenitic and ferritic stainless steels, grain boundaries can be preferentially attacked in a corrosive medium if the metal is sensitized as a result of heat treatment. Traditionally, sensitization refers to the intergranular precipitation of chromium carbides and the depletion of chromium concentration adjacent to the grain boundaries. For some coating systems, heat treatment is necessary to densify the coating, promote formation of the hard phase component and provide the metallurgical bond between the coating and the substrate.

Examination of tungsten carbide based coatings plasma sprayed onto AISI 316 stainless steel substrates exposed to a corrosive medium revealed that sensitization occured in a region adjacent to the coating/substrate interface. Specifically, sensitization occured mostly at the diffusion zone where the precipitation of chromium-rich carbides takes place due to the effects of heat treatment.

In this diffusion zone, plate-like Cr-rich carbide ($M_{23}C_6$ type) precipitated at the grain boundaries, extending to a depth approximately $1.27\times10^3$ $\mu$m (0.050 inch) below the coating/substrate interface, and granular chromium carbide ($M_7C_3$ type) precipitated within grains to a depth of approximately $3\times10^2$ $\mu$m (0.012 inch) beneath the coating.

However, it has been found that in the $Mo_2NiB_2$ coating/316 stainless steel couple a Widmanstgtten structure of boride precipitates formed to a depth of approximately 50 $\mu$m (0.02 inch) below the coating and granular and plate-like borides precipitated at grain boundaries to a depth of about $2.8\times10^2$ $\mu$m (0.011 inch) below the coating/substrate interface. These coatings therefore exhibited a diffusion zone which was not only composed of boride precipitates but which was also significantly smaller than that observed in the tungsten carbide based coating/316 stainless steel couple.

Figure 6:
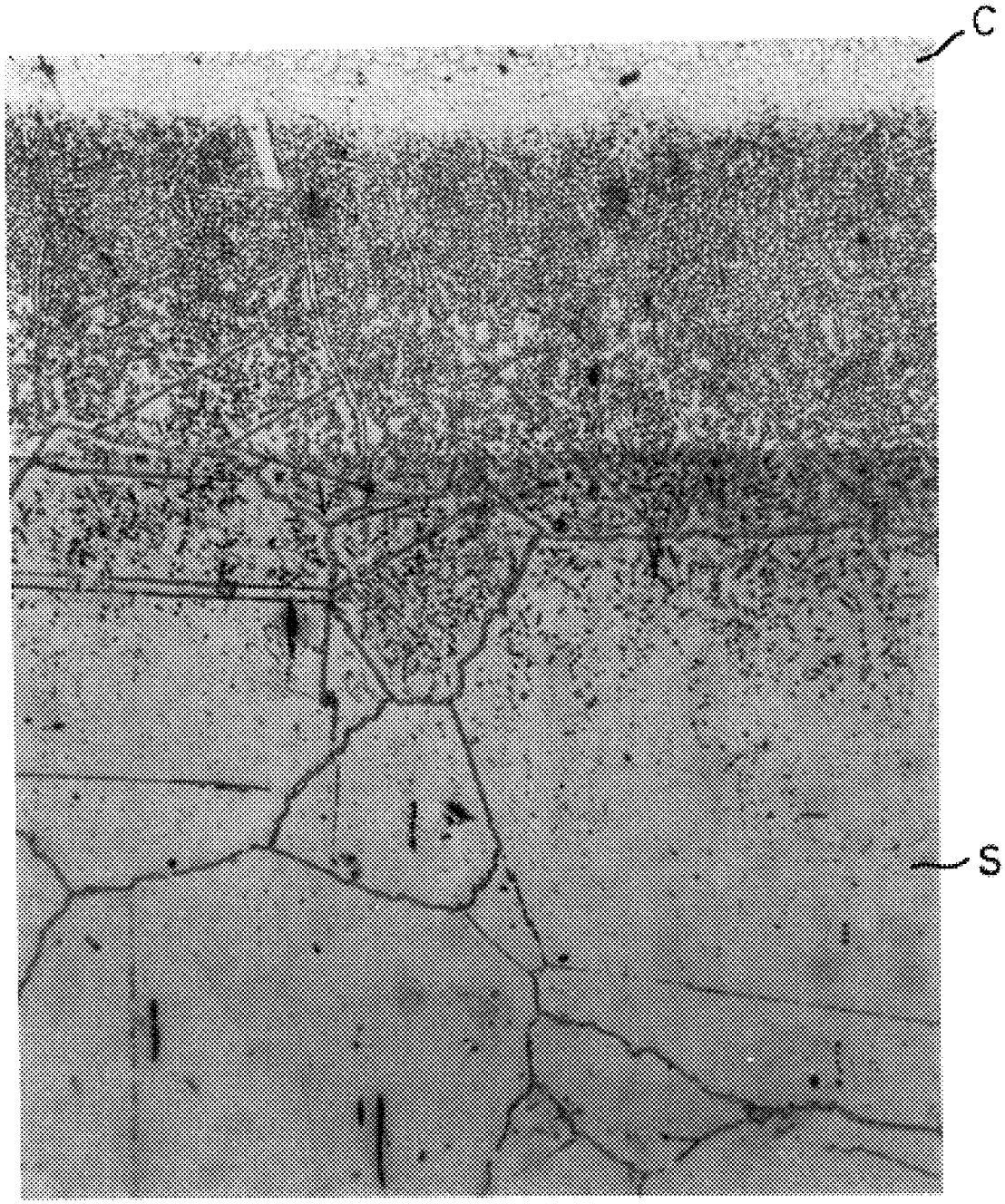
FIG. 6 is a photomicrograph taken at a magnification of 200× and showing a cross-section of the diffusion zone between a plasma sprayed and heat treated tungsten carbide based coating and a stainless steel substrate after exposure to a corrosive medium.
Figure 7:
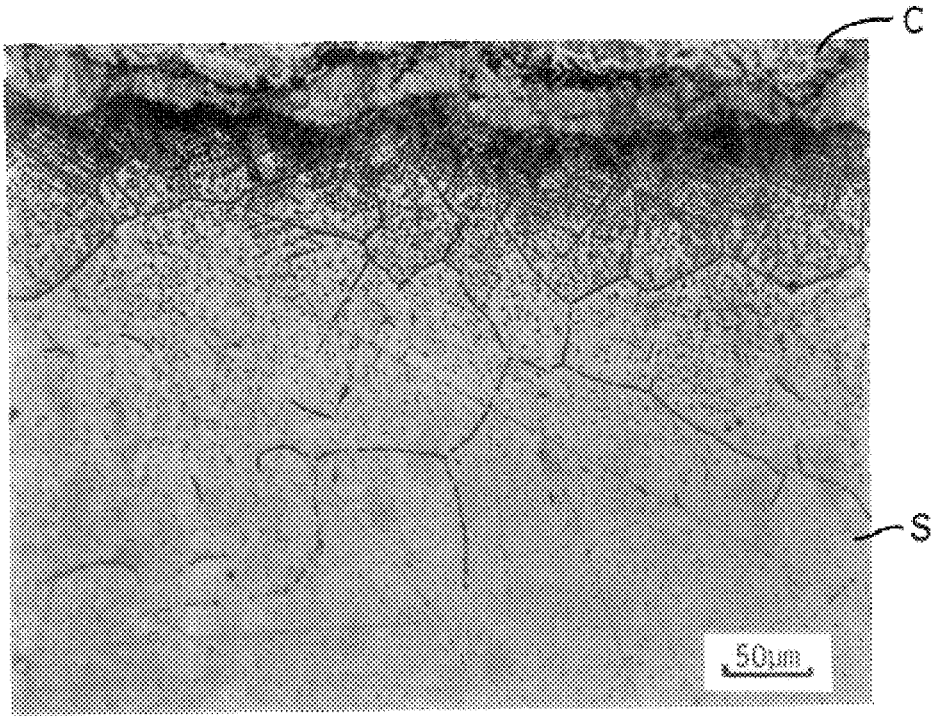
FIG. 7 is a photomicrograph taken at a magnification of 200× and showing a cross-section of the diffusion zone between a $Mo_2NiB_2$ coating and a stainless steel substrate after exposure to a corrosive medium.
Figure 8:
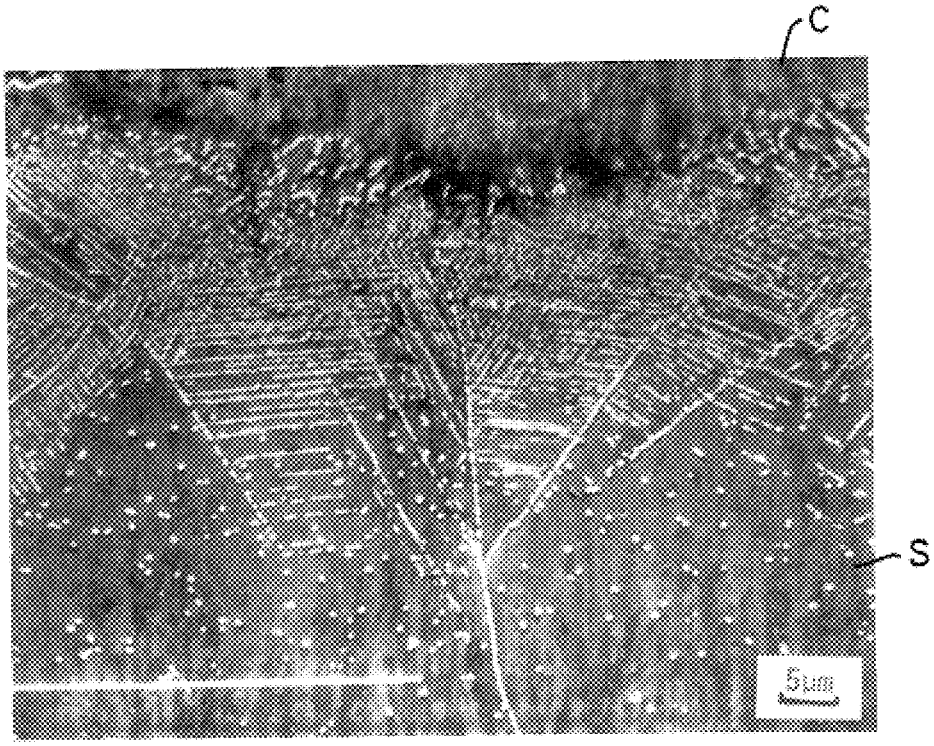
FIG. 8 is a photomicrograph taken at a magnification of 1500× and showing in enlarged detail the diffusion zone between the $Mo_2NiB_2$ coating and substrate shown in FIG. 7.

FIG. 6 shows the microstructure of the diffusion zone in a typical heat treated tungsten carbide based coating/316 stainless steel couple. FIGS. 7 and 8 show the Widmanstatten structure of the diffusion zone in a $Mo_2NiB_2$ coating/316 stainless steel couple prepared according to the present invention.

Analysis of chromium concentration in the matrix between precipitates and in the chromium depleted zone adjacent to grain boundary precipitates has been made by scanning electron microscope technique. It has been found that in the carbide precipitation zone (i.e., tungsten carbide based coating/316 stainless steel), the Cr concentration in the matrix varies from about 8 to 9 wt. % which is far less than the lower limit of Cr content needed for corrosion resistance in stainless steel, i.e., at least 11 wt. % Cr, while the Cr concentration in the matrix was 15 to 16 wt. % in the boride precipitation zone.

In the corrosion test, samples of both boride and carbide coatings on AISI 316 stainless steel substrates were immersed in various test solutions for specific periods of time and temperature as follows: tap water/25 days/25° C.; 3 wt. % salt water/11 days/25° C.; 50 wt. % NaOH/1 day/80° C.; 5 wt. % $H_2SO_4$/1 day/34° C.; 5 wt. % $HNO_3$/2 days/25° C.; 1 wt. % HCl/2 days/25° C.; and 25 wt. % HCl/1 day/25° C. After removal from the test solutions, the samples were cleaned ultrasonically in water and methanol for 5 minutes.

Intergranular corrosion attack appeared in the sensitization zone of the tungsten carbide based coating/316 stainless steel couple in all cases except in the tap water test for 25 days at 25° C. In $H_2SO_4$, $4HNO_3$, HCl and salt water tests, severe attack and excavation of grains clearly occurred in the heavy carbide precipitation zone. Beneath this zone, deep attack appeared in the regions along the carbide-precipitated grain boundaries. This was probably attributed to the lower corrosion resistance of the Cr depletion zone and/or a galvanic cell action between the carbides (cathode) and surrounding matrix (anode) leading to the dissolution of the matrix. Cracks in the carbide coating were observed in the tests of 5 wt. % $HNO_3$, 5 wt. % $H_2SO_4$ and 25 wt. % HCl. This may be due to a high residual stress in this coating. In the NaOH test, general corrosion attack occurred in the region of heavy carbide precipitation and intergranular corrosion appeared at carbide-precipitated grain boundaries.

The samples of $Mo_2NiB_2$ coating plasma sprayed onto the AISI 316 stainless steel substrate showed completely different corrosion properties. No noticeable corrosion attack in the diffusion zone of the boride/316 stainless steel couple was observed in the test of tap water, 3 wt. % salt water or 5 wt. % $HNO_3$, and only a very few shallow corrosion pits were found in the 316 stainless steel substrate adjacent to the coating after 1 day in NaOH at 80° C. In the 5 wt. % $H_2SO_4$ and 1 wt. % HCl test, a slight general corrosion attack occurred in the diffusion zone. In the 25 wt. % HCl/1 day/25° C. test, general corrosion and grain boundary corrosion prevailed in the 316 stainless steel substrate. The grain boundary corrosion was pronounced in the region adjacent to the coating and the coating/substrate interface. Although the grain boundaries in the diffusion zone of the boride/316 stainless steel couple were preferentially attacked by strong HCl acid, the corrosion attack in this region was entirely different from the carbide coating/316 stainless steel couple.

It should be noted that both the carbide and boride coatings were attacked by all the acids used in the tests to some degree. The boride coating was somewhat more resistant to $HNO_3$ and HCL solutions than the carbide coating. They both were comparable in corrosion resistance to $H_2SO4$.

The difference in corrosion characteristics between the two coating substrate couples can be understood in terms of the structure and formation of the precipitates. In the carbide-precipitated diffusion zone as a result of the formation of sheet-like carbide at grain boundaries, the carbides were fully surrounded by the Cr depleted matrix which was leached out and produced deep "ditches" at grain boundaries. However, spherical borides precipitated discontinuously at grain boundaries in the boride precipitated diffusion zone without severe depletion of Cr in the adjacent matrix. Some degree of corrosion attack at grain boundaries, but without producing a deep ditch structure was observed in the boride coating/316 stainless steel couple.

In any coating system, as a result of heating during service, components are often distorted due to the differential thermal expansion stress between the coating and the substrate. For example, this deflection characteristic plays an important role in mechanical face seal applications. Coating systems of Alloy No. 2+38 Mo+7(Ni-20 Cr) and tungsten carbide based coating were evaluated for their deflection effects due to a change in temperature from 40 to 110° C. on annular seal rings of AISI 316, AISI 410[6], AISI 430[7], 20Cb-3[8] and INCO 718[9] stainless steels with dimensions of 3⅜ inch I.D., 4⅜ inch O.D. and ½ inch thickness. The deflections of these systems were determined by measuring helium light bands generated between the deflecting coating/substrate and an optical plate. Due to the relatively higher thermal expansion coefficient and lower elastic modulus, the deflection of Alloy No. 2+38 Mo+7 (Ni-20 Cr) was less than that of tungsten carbide based coatings when coupled with the same substrate materials.

[6]AISI 410 is an austenitic stainless steel approx. 12.5 Cr, 0.15 (max)C, balance iron). [7]AISI 430 is an austenitic stainless steel (approx. 16.0 Cr, 0.12(max)C, balance iron). [8]20Cb-3 is a stainless steel (approx. 20 Cr, 35 Ni, 2 Mn, 1.0 Si, 2.5 Mo, 3.5 Cu, 0.07 C, balance iron). [9]INCO 718 is a nickel base alloy (approx. 19 Cr, 18.5 Fe, 3 Mo, 5.1 Ta+Nb, balance nickel).

EXAMPLE VI

A number of $W_2NiB_2$ coatings were prepared by plasma spraying powder mixtures of tungsten and a boron-containing alloy onto AISI 1018 steel specimens to a thickness of about 0.020 inch (0.5 mm). The mix formulations were as follows:

(1) Alloy No. 2+40 W (2) Alloy No. 2+42 W+9 Cr (3) Alloy No. 5+50 W.

These formulations represent W to B atomic ratios of 0.55, 0.71 and 1.0, respectively. The as-deposited coatings were heat treated for one hour at temperatures of about 980 to 1020° C. in vacuum or argon. The coatings were examined after heat treatment and found to consist of $W_2NiB_2$ precipitates dispersed in a Ni—Cr—Si—Fe matrix. It should be noted that a small amount of CrB precipitate was formed in the coatings using Alloy No. 2 due to the excess boron. The precipitates were formed by a diffusion reaction proceeding according to Equation (3) above except where additional chromium metal was used. In this case, the reaction proceded according to Equation (5). The volume fraction of the precipitates was about 46 to 56 percent.

The hardness of these $W_2NiB_2$ coatings ranged from about 800 to 1200 $DPH_{300}$(HV.3)

Abrasion and erosion properties of the coatings were evaluated using the same test procedures described in Example I. The sand abrasion wear rate of the coatings prepared using Alloy No. 2+40 W was 2.2 $mm^3$/1000 revolutions. The erosive wear to alumina particles at 90 and 30° impingement angles was approximately 93 and 34 micrometers per gram, respectively. The wear and erosion resistant properties of these coatings is comparable to that of $Mo_2NiB_2$ coatings prepared in the previous examples.

The coatings prepared using Alloy No. 2+42 W+9 Cr and Alloy No. 5+50 W both contained approximately 10 wt. % Cr. This illustrates that Cr can be added to modify corrosion properties via the addition of a third component or by using a boron-containing alloy with relatively high Cr content. Corrosion tests of Alloy No. 5+50 W, Alloy No. 4+40Mo+11.3 Cr, and tungsten carbide based coatings on INCO 625[10] blocks (1"×½"×¾") were carried out by immersing the samples in 3 wt. % NaCl solution at room temperature for 10 days. The total weight losses were 0.0002, 0.0035, and 0.0016 grams, respectively. Considering experimental error, Alloy No. 5+50 W had nearly no weight loss. Thus, it is likely that the Alloy No. 5+50 W/INCO 625 couple could be used for face seal applications in a marine environment, as well as other applications.

[10]INCO 625 is a nickel base alloy (approx. 21.5 Cr, 2.5 Fe, 9.0 Mo, 3.6 Ta & Cb, balance nickel)

EXAMPLE VII

A number of WCoB coatings were prepared by plasma spraying powder mixtures of tungsten, Alloy No. 2 and cobalt onto AISI 1018 steel to a thickness of about 0.020 inch (0.5 mm). The mix formulation was as follows: W+40 Alloy No. 2+14.6 Co. The W to B atomic ratio was about 1.0. The as-deposited coating was heat treated for one hour at temperatures of from about 980 to 1060° C. in vacuum or argon. These coatings after heat treatment consisted of WCoB precipitates (particle size less than about 1 micrometer) dispersed in a Ni—Cr—Si—Fe matrix. The volume fraction of the precipitates was about 58 percent. The sand abrasion wear of these coatings was approximately 1.4 to 1.8 $mm^3$/1000 revolutions. The erosive wear to alumina dust at 90° and 30° impingement angles was 95 and 27 micrometers per gram, respectively. The abrasion and erosion wear resistance of these coatings was therefore good.

EXAMPLE VIII

A number of $TiB_2$ coatings were prepared by plasma spraying powder mixtures of titanium, Alloy No. 3 and chromium onto AISI 1018 steel specimens to a thickness of about 0.020 inch (0.5 mm). The mix formulation was as follows: Alloy No. 3+35 Ti+5 Cr. The Ti to B atomic ratio was about 0.94. The as-deposited coatings were heat treated for about one hour at temperatures of between about 980 and 1070° C. in vacuum or argon. The coatings exhibited a lamellar structure of very fine $TiB_2$ hard precipitates uniformly dispersed in a Ni—Cr—Si—Fe matrix. The volume fraction of the precipitates was about 40 percent. The sand abrasion wear rate of these coatings was about 2.7 $mm^3$/1000 revolutions. The erosive wear to alumina dust at impingement angles of 90° and 30° was 112 and 28 μm/gram, respectively. The abrasion and erosion wear properties of these coatings were somewhat lower than that of the $W_2NiB_2$ and WCoB coatings prepared in the previous examples although they were still good.

EXAMPLE IX

A number of niobium boride coatings were prepared by plasma spraying powder mixtures of niobium and Alloy No. 6 onto AISI 1018 steel specimens to a thickness of about 0.02 inch (0.5 mm). The mix formulation was as follows: Alloy No. 6+45 Nb. The Nb to B atomic ratio was about 1.12. The as-deposited coatings were heat treated for about one hour at temperatures of between 980 and 1040° C. in vacuum or argon. The coatings consisted of niobium boride precipitates, with a particle size of less than 2 micrometers, uniformly dispersed in a Ni—Cr—Si—Fe matrix. The sand abrasion wear rate of these coatings was about 2.4 $mm^3$/1000 revolutions. The erosive wear to alumina paricles at impingement angles of 90° and 30° was gram, respectively. The abrasion and erosion wear properties of these coatings were reasonably good.

EXAMPLE X

A number of ZrB coatings were prepared by plasma spraying powder mixtures of zirconium hydride and Alloy No. 2 onto AISI 1018 steel specimens to a thickness of about 0.020 inch (0.5 mm). The mix formulation was as follows: Alloy No. 2+35 $ZrH_2$. The Zr to B atomic ratio was about 1.0. The $ZrH_2$ thermally decomposes during spray depositing Zr metal. The as-deposited coatings were heat treated for about one hour at temperatures of between about 980 and 1060° C. in vacuum or argon. The coatings consisted of fine $ZrB_2$ precipitates dispersed in a Ni—Cr—Si—Fe matrix. The volume fraction of the precipitates was about 30 percent. The sand abrasion wear rate of these coatings was about 4.9 $mm^3$/1000 revolutions. The erosive wear to alumina particles at impingement angles of 90° and 30° was 109 and 30 μm/gram, respectively. The abrasion and erosion wear properties of these coatings were also lower than those of the $W_2NiB_2$ and WCoB coatings prepared in the previous examples.

Table V below summarizes the properties of the coatings prepared in the foregoing examples. The table also includes conventional tungsten carbide coating produced by Union Carbide and designated UCAR[2] LW-1N30 (detonation gun) and UCAR[2] LW-26 (plasma spray).

EXAMPLE XI

Coatings and substrates when heat treated often expand or contract at different rates. This can result in undesirable microcracks in the coatings or even spalling. The heat treatment of coatings on hardenable steels, such as AISI 4130/4140[11], 410 stainless steel and 17-4PH[12] stainless steel, which undergo phase transformations, is particularly detrimental to the coating.

A number of $Mo_2NiB_2$ coatings were applied on a variety of substrate materials: Alloy No. 1+30, 35 and 38 Mo coatings on AISI 410 stainless steel and AISI 4140 steel (1"×3"×4"), Alloy No. 2+38 Mo+7(Ni-20 Cr) and Alloy No. 2+33 Mo+17(Ni-20 Cr) on AISI 410 stainless steel and AISI 4140 steel substrates (1"×3"×4") and an annular seal ring of 17-4PH[12] (3⅛" I.D., 5⅛" O.D. and 9/16" thick). After heat treatment, any cracks in the coating and/or the substrate were revealed using metallographic examination and dye penetrant techniques. It was found that crack-free coatings were obtained with the systems of Alloy No. 1+25 Mo/410 stainless steel or 4140 steels and Alloy No. 2+33 Mo+17 (Ni-20 Cr)/17-4PH or 410 stainless steel. This would not be possible with the tungsten carbide coatings.

[11]AISI 4130 is an austenitic stainless steel (approx. 0.3 C, 0.5 Mn, 0.2 Si, 1.0 Cr, 0.2 Mo, balance iron)-AISI 4140 is an austenitic stainless steel (approx. 0.4 C, 0.9 Mn, 0.2 Si, 1.0 Cr, 0.2 Mo, balance iron).

[12]17-4PH is a steel (approx. 16.5 Cr, 4.25 Ni, 0.25 Nb, 3.6 Cu, 0.04 C(max), balance iron.)

TABLE V

| | Chemical Composition (wt%) | | | | | | | |
|---|---|---|---|---|---|---|---|---|
| Powder Mixture | Ni | Mo | B | Cr | Si | Fe | Co | Other |
| Alloy No. 1 + 15Mo | bal. | 15 | 2.55 | 5.95 | 3.4 | 3.4 | — | — |
| Alloy No. 1 + 25Mo | bal. | 25 | 2.25 | 5.25 | 3.0 | 3.0 | — | — |
| Alloy No. 1 + 30Mo | bal. | 30 | 2.1 | 4.9 | 2.8 | 2.8 | — | — |
| Alloy No. 1 + 35Mo | bal. | 35 | 1.95 | 4.55 | 2.6 | 2.6 | — | — |
| Alloy No. 1 + 38Mo | bal. | 38 | 1.86 | 4.34 | 2.48 | 2.48 | — | — |
| Alloy No. 2 + 33Mo + 17(Ni—20Cr) | bal. | 33 | 3.65 | 5.3 | 1.05 | — | — | — |
| Alloy No. 2 + 38Mo + 7(Ni—20Cr) | bal. | 38 | 4.01 | 3.49 | 1.16 | — | — | — |
| Alloy No. 6 + 45Mo | bal. | 45 | 4.68 | 1.93 | 1.1 | 0.83 | — | — |

TABLE V-continued

| | | | | | | | | |
|---|---|---|---|---|---|---|---|---|
| Alloy No. 4 + 45Mo | bal. | 45 | 4.92 | 1.65 | 1.21 | 1.49 | — | — |
| Alloy No. 4 + 41.7Mo + 7.3Cr | bal. | 41.7 | 4.56 | 8.79 | 1.12 | 1.38 | — | — |
| Alloy No. 4 + 43.3Mo + 3.9Cr | bal. | 43.3 | 4.71 | 5.43 | 1.16 | 1.43 | — | — |
| Alloy No. 4 + 40Mo + 11.3Cr | bal. | 40.0 | 4.36 | 12.44 | 1.07 | 1.32 | — | — |
| Mo + 42 Alloy No. 3 + 5Cr | bal. | 53 | 5.88 | 5 | — | — | — | — |
| Alloy No. 2 + 45(Mo—30W) * | bal. | 31.5 | 4.01 | 3.49 | 1.16 | — | — | 13.5W |
| Alloy No. 2 + 42W + 9Cr | bal. | — | 3.63 | 10.63 | 1.06 | 0.68 | — | 42W |
| Alloy No. 4 + 40W | bal. | — | 4.38 | 3.81 | 1.27 | — | — | 40W |
| Alloy No. 5 + 50W | bal. | — | 3.00 | 10.00 | — | — | — | 50W |
| W + 40 Alloy No. 2 + 14.6Co | 34.7 | — | 2.92 | 1.56 | 0.84 | — | 14.6 | 45.4W |
| Alloy No. 2 + 35$ZrH_2$ | bal. | — | 4.18 | 2.45 | 1.53 | 0.85 | — | 35$ZrH_2$ |
| Alloy No. 3 + 35Ti + 5Cr | bal. | — | 8.4 | 5 | — | — | — | 35Ti |
| Alloy No. 6 + 45Mb | bal. | — | 4.68 | 1.93 | 1.1 | 0.83 | — | 45Nb |
| Alloy No. 3 + 45Cr | bal. | — | 7.7 | 45 | — | — | — | — |
| Alloy No. 4 + 30Cr | bal. | — | 6.79 | 32.2 | 1.82 | 1.47 | | |
| LW-1N30(D) | W—10.7Co—3.6C—0.6Fe | | | | | | | |
| LW-26(P) | W—30Mi—6Co—3.25B—2.9C—1.1Cr—0.8Si—0.98Fe | | | | | | | |

| Powder Mixture | Atom Ratios M/B | Hardness VPN 300 | Sand Abrasive Wear ($mm^3$/1000) | Alumina Erosion $\mu$m/g 90°/30° | Silica Erosion $\mu$m/g 90°/30° | Volume Fraction of Hard Phase (%) | Adhesive Wear Against LW-15, Vol. Loss ($mm^3$) |
|---|---|---|---|---|---|---|---|
| Alloy No. 1 + 15Mo | 0.66 | 658(75)* | 8.3 | 93/34 | — | 22 | |
| Alloy No. 1 + 25Mo | 1.1 | 509(51) | 4.5 | 72/33 | — | 30 | |
| AIloy No. 1 + 30Mo | 1.6 | 556(52) | 3.8 | 73/33 | — | ~38 | |
| Alloy No. 1 + 35Mo | 1.88 | 562(113) | 3.2 | 73/33 | — | ~42 | |
| Alloy No. 1 + 38Mo | 2.3 | 520(129) | 2.8 | 68/25 | — | ~45 | 2.31/024 |
| Alloy No. 2 + 33Mo + 17(Ni—20Cr) | 1.02 | 600(160) | 2.7 | 68/24 | — | — | |
| Alloy No. 2 + 38Mo + 7(Ni—20Cr) | 1.03 | 655(155) | 1.7–1.9 | 87/24 | 3.4/1.5 | 67–69 | |
| Alloy No. 6 + 45Mo | 1.08 | 951(416) | 1.3–1.6 | 98/30 | 3.0/0.9 | 62–77 | |
| Alloy No. 4 + 45Mo | 1.03 | 671(248) | 1.3 | 87/28 | — | 64 | |
| Alloy No. 4 + 41.7Mo + 7.3Cr | 1.03 | 729(83) | 1.7 | 74/22 | 1.8/0.6 | 59 | |
| Alloy No. 4 + 43.3Mo + 3.9Cr | 1.03 | 467(168) | 1.6 | 78/27 | — | 61 | |
| Alloy No. 2 + 40Mo + 11.3Cr | 1.03 | 534(143) | 1.8 | 74/24 | — | 57 | |
| Mo + 42 Alloy No. 3 + 5Cr | 1.01 | 807(234) | 1.3 | 91/24 | — | 75 | |
| Alloy No. 2 + 45(Mo—30W) | — | 669(322) | 1.4 | 70/25 | — | ~60 | |
| Alloy No. 2 + 42W + 9Cr | 0.71 | 872(189) | 2.4 | 88/30 | — | 46 | |
| Alloy No. 4 + 40W | 0.55 | 1165(175) | 2.2 | 93/34 | — | 44 | |
| Alloy No. 5 + 50W | 1.0 | 838(248) | 2.1 | 67/20 | — | 56 | |
| W + 40 Alloy No. 2 + 14.6Co | 1.0 | 665(100) | 1.4–1.8 | 95/27 | 6.0/3.4 | 58 | |
| Alloy No. 2 + 3S$ZrH_2$ | 1.0 | 966(151) | 4.9 | 109/30 | — | 30 | |
| Alloy No. 3 + 35Ti + 5Cr | 0.94 | 661(132) | 2.7 | 112/28 | — | 40 | |
| Alloy No. 6 + 45Nb | 1.12 | 789(71) | 2.4 | 128/34 | — | — | |
| Alloy No. 3 + 45Cr | 1.21 | 825(94) | 4.8 | 124/36 | — | 60 | |
| Alloy No. 4 + 30Cr | 1.0 | 740(85) | 4.7 | 122/37 | | 43 | 7.0/0.71 |
| LW-1N30(D) | — | 1100 | 1.5 | 100/36 | 5.1/2.2 | — | |
| LW-26(P) | — | 1100 | 1.5–2.0 | 84/18 | 7.6/3.9 | — | |

*Standard deviation for 15 measurements
**coating loss on block/LW-15 loss on ring for 1000 cycles at 360 lb. load

I claim:

1. A wear and corrosion resistant coating on a substrate, said coating comprising hard, ultrafine, transition metal boride particles dispersed in a metal matrix comprising at least one of nickel, cobalt and iron, the particles constituting from about 30 to about 90 volume percent of the coating, the balance being metal matrix.

2. A coating according to claim 1 wherein the atomic ratio of transition metal to boron in said coating is between about 0.4 and about 2.0.

3. A coating according to claim 1 wherein the average size of said particles ranges from about 0.5 to about 3.0 microns.

4. A coating according to claim 1 having a hardness from about 500 to about 1200 $DPH_{300}$ (HV.3).

5. A coating according to claim 1 wherein the particles are composed of a boride of at least one transition metal selected from groups IVB, VB and VIB of the Periodic Table.

6. A coating according to claim 5 wherein the transition metal is selected from the group consisting of niobium, chromium, molybdenum, titanium, zirconium and tungsten.

7. A coating according to claim 6 wherein the transition metal is molybdenum.

8. A coating according to claim 1 wherein the metal matrix contains at least one metal selected from the group consisting of molybdenum, chromium, manganese, aluminum and silicon.

9. A coating according to claim 1 wherein the metal matrix contains at least one metal selected from the group consisting of molybdenum, chromium, manganese, aluminum and silicon.

10. A coating according to claim 1 wherein the particles constitute from about 40 to 80 volume percent of the coating.

11. A coating according to claim 1 having a thickness within the range of from about 0.005 to about 0.040 inch.

12. A coating according to claim 1 wherein the substrate is a material selected from the group consisting of steel, stainless steel, iron base alloys, nickel, nickel base alloys, cobalt, cobalt base alloys, chromium, chromium base alloys, titanium, titanium base alloys, refractory metals, and refractory metal base alloys.

13. A coating according to claim 12 wherein the substrate is a steel.

14. A coating according to claim 13 wherein the substrate is an austenitic stainless steel.

15. A coating according to claim 1 comprising $Mo_2NiB_2$ particles dispersed in a Ni—Cr—Si—Fe matrix.

16. A coating according to claim 1 comprising CrB particles dispersed in a Ni—Cr—Si—Fe matrix.

17. A coating according to claim 1 comprising $W_2NiB_2$ particles dispered in a Ni—Cr—Si—Fe matrix.

18. A coating according to claim 1 comprising $W_2CoB_2$ particles dispersed in a Ni—Cr—Si—Fe matrix.

19. A coating according to claim 1 comprising $TiB_2$ particles dispersed in a Ni—Cr—Si—Fe matrix.

20. A coating according to claim 1 comprising $ZrB_2$ particles dispersed in a Ni—Cr—Si—Fe matrix.

21. A coating according to claim 1 comprising $Mo_2NiB_2$ and CrB in a Ni—Cr—Si—Fe matrix.

22. A wear and corrosion resistant coating on a substrate, said coating comprising multiple, thin, irregularly shaped splats overlapping and bonded to one another and to said substrate, said splats comprising hard, ultrafine, transition metal boride particles dispersed in a metal matrix comprising at least one of nickel, cobalt and iron, said particles having a size less than about 3 microns.

23. A coating according to claim 22 wherein the particles constitute from about 30 to about 90 volume percent of said coating, the balance being metal matrix.

24. A coating according to claim 22 wherein the atomic ratio of transition metal to boron ranges from about 0.4 to about 2.0.

25. A coating according to claim 22 wherein the average size of said particle is from about 0.5 to about 1.0 micron.

26. A coating according to claim 22 wherein the particles are composed of a boride of at least one transition metal selected from groups IVB, VB and VIB of the Periodic Table.

27. A coating according to claim 22 wherein the transition metal is selected from the group consisting of niobium, chromium, molybdenum, titanium, zirconium and tungsten.

28. A coating according to claim 22 wherein the transition metal is molybdenum.

29. A coating according to claim 28 wherein the molybdenum is present in an amount ranging from about 25 to about 70 weight percent of the coating.

30. A coating according to claim 22 wherein the particles are composed of a transition metal boride selected from the group consisting of TiB, $TiB_2$, ZrB, $ZrB_2$, HfB, $HfB_2$, $V_3B_2$, $VB_2$, $Nb_3B_2$, $NbB_2$, $Ta_2B$, $TaB_2$, $Cr_2B$, CrB, $CrB_2$, $Mo_2B$, MoB, $Mo_2B_5$, $W_2B$, $W_2B_5$, $Mo_2NiB_2$ and $W_2NiB_2$.

* * * * *

UNITED STATES PATENT AND TRADEMARK OFFICE

CERTIFICATE OF CORRECTION

PATENT NO. : 5,981,081
DATED : November 9, 1999
INVENTOR(S) : Sue

It is certified that error appears in the above-identified patent and that said Letters Patent is hereby corrected as shown below:

Title page,
Item [73], Assignee, delete "Union Carbide Coatings Service Corporation" and insert -- Praxair S.T. Technology, Inc. --

Signed and Sealed this

Fifth Day of November, 2002

*Attest:*

*Attesting Officer*

JAMES E. ROGAN
*Director of the United States Patent and Trademark Office*